US006296352B1

(12) United States Patent
Hollands et al.

(10) Patent No.: US 6,296,352 B1
(45) Date of Patent: Oct. 2, 2001

(54) INK SUPPLY CONTAINER SUITABLE FOR CONNECTION TO AN INKJET PRINTHEAD

(75) Inventors: Peter Joseph Hollands, Venlo; Hans Reinten, Velden, both of (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/233,077

(22) Filed: Jan. 19, 1999

(30) Foreign Application Priority Data

Jan. 16, 1998 (NL) ..... 1008040

(51) Int. Cl.[7] ..... B41J 2/175
(52) U.S. Cl. ..... 347/86
(58) Field of Search ..... 347/85, 86, 87, 347/30, 92, 93

(56) References Cited

U.S. PATENT DOCUMENTS

| | | | | |
|---|---|---|---|---|
| 4,509,062 | | 4/1985 | Low et al. . | |
| 4,571,599 | | 2/1986 | Rezanka . | |
| 4,791,438 | | 12/1988 | Hanson et al. . | |
| 4,893,138 | * | 1/1990 | Terasawa et al. | 347/30 |
| 5,039,999 | | 8/1991 | Winslow et al. . | |
| 5,351,073 | * | 9/1994 | Kageyama et al. | 347/87 |
| 5,457,485 | * | 10/1995 | Moriyama et al. | 347/92 |
| 5,481,289 | * | 1/1996 | Arashima et al. | 347/93 |

FOREIGN PATENT DOCUMENTS

| | | |
|---|---|---|
| 19 534577A1 | 3/1996 | (DE) . |
| 19 613654A1 | 10/1996 | (DE) . |
| 0 381392 | 8/1990 | (EP) . |
| 0 444654A1 | 9/1991 | (EP) . |
| 0 536980A2 | 4/1993 | (EP) . |
| 0 605183A2 | 7/1994 | (EP) . |
| 0 645244A1 | 3/1995 | (EP) . |

* cited by examiner

*Primary Examiner*—N. Le
*Assistant Examiner*—Anh T. N. Vo

(57) ABSTRACT

An ink supply container defining an ink chamber wherein the ink supply container is provided with an ink filling opening leading into the ink chamber and an ink outflow opening leading out of the ink chamber, the ink outflow opening being suitable for connection to an inkjet printhead, the ink supply container further being provided with, or at least being connectable to, means for maintaining a negative pressure in the ink chamber. The ink chamber is separated from the ink filling opening by a porous material.

13 Claims, 6 Drawing Sheets

INK SUPPLY CONTAINER SUITABLE FOR CONNECTION TO AN INKJET PRINTHEAD

BACKGROUND OF THE INVENTION

Figure 1A:
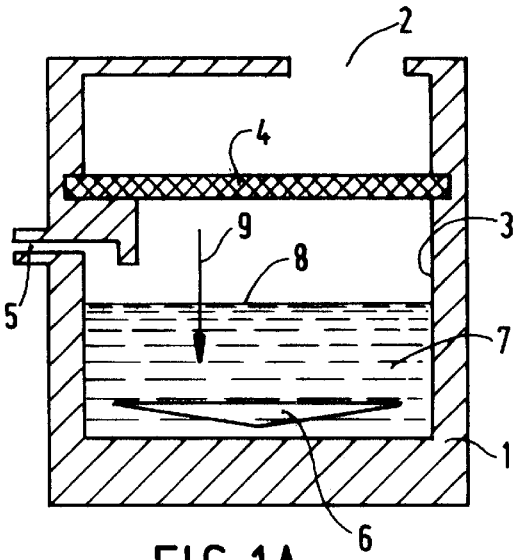

The present invention relates to an ink supply container comprising an ink chamber wherein the ink supply container is provided with an ink filling opening leading into the ink chamber and an ink outflow opening leading out of the ink chamber, the ink outflow opening being suitable for connection to an inkjet printhead, the ink supply container further being provided with, or at least being connectable to, means for maintaining a negative pressure in the ink chamber. The present invention also relates to an inkjet system comprising an inkjet printhead and an ink supply container.

In an inkjet arrangement, a negative pressure should be present in the ink reservoir or in the ink duct connected to the nozzles of an inkjet printhead in order to prevent undesirable leakage of the ink through the nozzles. This requirement means that replenishing an ink supply container with ink is not an immediately simple matter. Unless a closed throwaway system is used, additional means must be provided for replenishment or else the ink supply container must be provided with a special construction to render replenishment possible.

In arrangements where the inkjet printhead is located above the ink reservoir, a negative pressure can be obtained hydrostatically as known, for example, from U.S. Pat. No. 4,571,599. This patent describes how a negative pressure can be maintained at the nozzles of an inkjet printhead by utilizing a completely shut-off main reservoir connected thereto and situated at a lower level than the inkjet printhead, and in which a negative pressure prevails. An auxiliary reservoir is present in this main reservoir and is in liquid communication therewith and contains an air bubble in which the pressure is equal to the atmospheric pressure. The atmospheric pressure is maintained therein by means of a diaphragm which is air-permeable but liquid-impermeable. A change of the ink level and hence of the pressure in the main reservoir is cancelled by admitting air into the auxiliary reservoir. A disadvantage of an arrangement of this kind is the requirement that the ink reservoir must be situated beneath the inkjet printhead in order to obtain the required hydrostatic pressure drop. Also, the system as described is designed as a throwaway system and the ink cannot be replenished.

In arrangements in which the inkjet printhead is situated at the same level as or a lower level than the inkjet reservoir, other methods must be applied to maintain a negative pressure.

For example, U.S. Pat. No. 4,509,062 describes an inkjet arrangement wherein the inkjet printhead is situated beneath a closed ink reservoir. The reservoir is in liquid communication with the nozzles of the inkjet printhead. In this case the required constant negative pressure is obtained by means of a diaphragm defining the ink reservoir, with an external force being applied to the diaphragm by means of a spring. The description also states that the diaphragm and spring can be combined by making the diaphragm of an elastic material. There is no indication how the reservoir can be replenished with ink.

U.S. Pat. No. 5,039,999 describes how a constant negative pressure is maintained in a closed inkjet reservoir by means of a piston in a cylindrical part of the ink reservoir. In this case the cylinder is in liquid communication with the closed ink reservoir. The volume of the ink reservoir is enlarged by the movement of the piston with a negative pressure being obtained therein. The space between the cylinder and the piston wall is, in this case, hermetically sealed by the ink present therein. The ink reservoir is closed by a special filling opening. Air bubbles are trapped in circular grooves between the piston and the cylinder wall. To fill the reservoir, a refill opening is used which is sealed by means of a plug. Continuous or automatic replenishment is not possible with this arrangement.

European Patent EP 0 444 654 describes an inkjet system with a closed ink reservoir provided with an ink injection opening and an air outlet valve. The required negative pressure is obtained by a sponge-like material present in the ink reservoir. In the operating mode, the ink injection opening forms the ink outlet duct so that an inkjet printhead connected to the ink outlet duct must be removed for any replenishment to take place.

European Patent EP 0 645 244 describes an inkjet arrangement wherein the inkjet printhead is situated beneath or next to an ink reservoir. The ink reservoir is removably connected, via a leak-free coupling, to a liquid transport duct leading to the nozzles of an inkjet printhead. The required negative pressure needed to compensate for the hydrostatic pressure and hence the spontaneous leakage of the ink is obtained by the capillary action of a sponge-like material disposed in the ink reservoir. A filter chamber is provided in this liquid transport duct and has therein an ink-permeable filter of metal gauze. The function of the metal gauze is to retain impurities in the ink. The reservoir is replaced when the ink has been used up.

U.S. Pat. No. 4,791,438 describes an inkjet arrangement wherein a negative pressures is maintained in a main reservoir by means of an extra reservoir connected via a capillary duct to the main reservoir, the negative pressure being maintained by the capillary action of said duct. Ink is fed to the extra reservoir via a supply opening intended for this purpose and sealable by means of a plug. Ink cannot be replenished continuously or automatically with this arrangement.

SUMMARY OF THE INVENTION

The ink supply container according to the PRESENT invention obviates the above disadvantages by providing that porous material is present between the ink filling opening and the ink chamber.

Suitably selected porous material in an ink-saturated state is permeable to ink but practically impermeable to air. As a result negative pressure can be maintained in the ink chamber while a continuous supply of ink is provided via the porous material. The negative pressure in the ink chamber contributes to the ink moving from the ink supply opening via the porous material to the ink chamber and remaining there. If the ink supply opening is situated above the ink chamber in an operative state, gravity can also play a part in the ink moving process. If no more ink is supplied, a quantity of ink determined by the capillary action will remain in the openings of the porous material. The surface tension exerted as a result of the ink in each opening is sufficient to counteract the negative pressure. Only when ink is again supplied via the ink supply opening is this surface tension broken and the ink can again move to the ink chamber.

In this connection it should be noted that the porous material also has a filter function in order to retain unwanted impurities in the ink supply. Also, providing filter material such as the said porous material at the ink supply opening instead of in a liquid transport duct between the ink chamber and an inkjet printhead is more advantageous due to the higher permissible throughflow resistance of the filter material. The minimum throughflow resistance in the first case is determined by the average quantity of ink to be transported, and not by the instantaneous quantity of ink to be transported. The throughflow resistance can then be greater and the openings smaller.

One advantageous embodiment is characterised in that the porous material has the smallest dimension in the direction pointing towards the ink chamber. An example of this is the thin wall of porous material closing off the ink chamber. In the case of a supply of ink, there is in this case a large movement of ink through the porous material in the direction of the ink chamber. For a hermetic seal, only a relatively thin layer of ink-saturated material is required, while a large surface towards the ink chamber is desirable for optimal supply.

Another advantageous embodiment is characterised in that the porous material is permeable to ink both in the direction pointing towards the ink chamber and in directions perpendicular thereto. As a result, when ink is supplied to part of the porous material, the ink spreads over the total surface thereof. In this way the hermetic seal is guaranteed and better transport of the ink to the ink chamber is obtained.

A further improved embodiment is characterised in that the porous material is formed by a regular woven fabric of threads or wires. In woven fabrics, the openings between the threads or wires are accurately fixed with regard to size and uniformity. As a result the risk of clogging or leakages is reduced. On the other hand, with woven fabrics there is a good movement of ink over the surface of the woven fabric itself.

One favourable embodiment of such a woven fabric is characterised in that the threads or wires in a first weaving direction have a diameter differing from the threads or wires in a second weaving direction. Woven fabrics of this kind are also known by the name "Dutch weave". In this embodiment, it is primarily the thinner threads or wires that are deformed. This results in an opening no longer lying in one straight plane, as in the case of sieve gauze, but in a curved plane. In a woven fabric of this kind, there is an improved spread of ink over the total surface of the woven fabric. Also, with this woven fabric, the passage openings are defined more accurately with regard to size. The sealing effect can be guaranteed more satisfactorily as a result.

Another embodiment is also characterised in that at least part of the porous material in an operative mode is in liquid contact with the ink normally present in the ink chamber in the operative mode. This provides an even better guarantee of saturation of the porous material with ink and prevents the porous material from passing air when the ink disappears therefrom.

In another advantageous embodiment, the ink supply container comprises a second ink chamber in liquid communication with the first ink chamber, the second ink chamber in the operative mode is situated above the first ink chamber when considered in the direction of gravity. Since all the porous material is now beneath the ink level of the second ink chamber, complete saturation of the porous material is obtained.

Another advantageous embodiment is obtained in that the plane formed by the porous material and directed towards the ink chamber forms, in the operative mode, a plane oriented obliquely with respect to the gravity direction. Any air present in the ink chamber and moving towards the ink surface defined by the porous material is now compelled to seek the highest point thereof. In this way such air does not accumulate in front of the porous material but can be discharged via an opening intended for this purpose.

In another advantageous embodiment, the ink supply container is provided with an opening leading out to the at least one ink chamber and suitable for connection to a device for applying a substantially constant negative pressure in the at least one ink chamber. In this case the device may, for example, comprise a diaphragm connected to a spring, a bellows construction or a piston and cylinder combination. In this way a negative pressure can be transmitted to the ink chamber and in particular also to that part of the ink chamber which adjoins the porous material.

DETAILED DESCRIPTION OF THE DRAWINGS

Figure 1B:
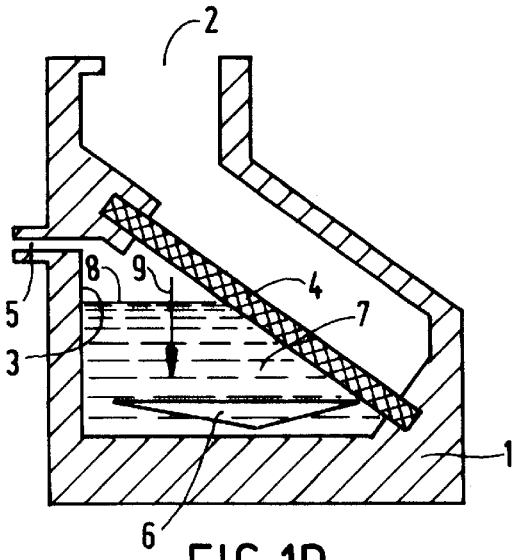
Figure 1C:
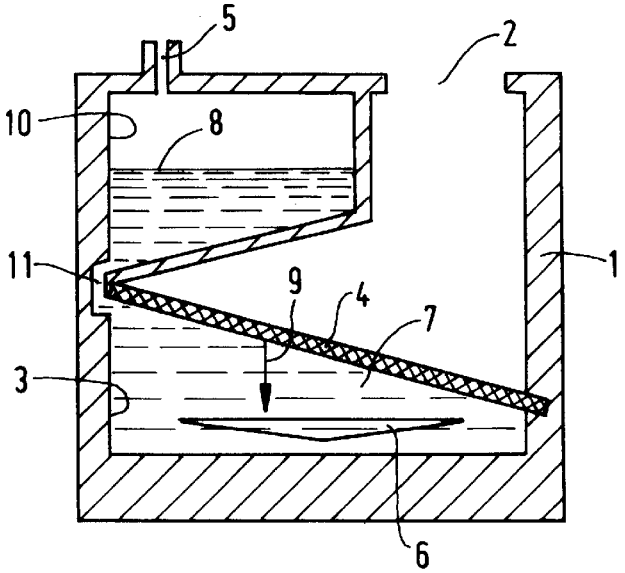
Figure 2A:
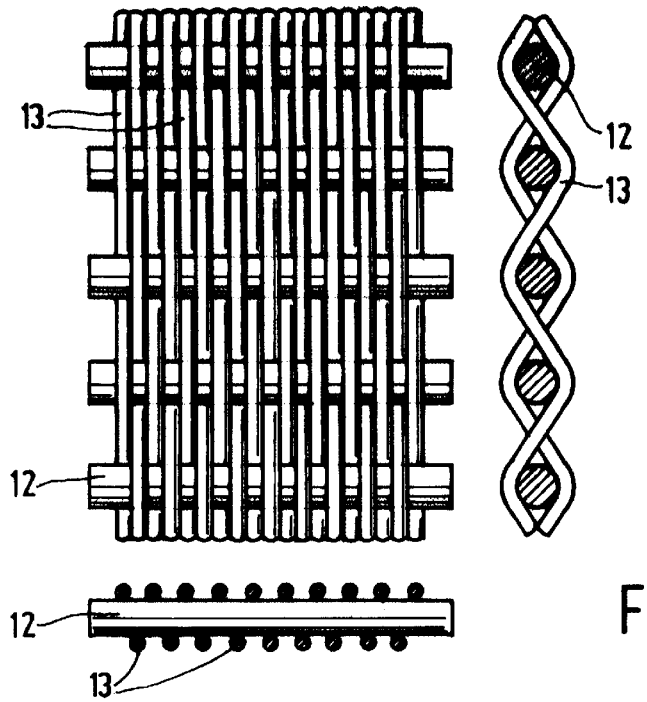
Figure 2B:
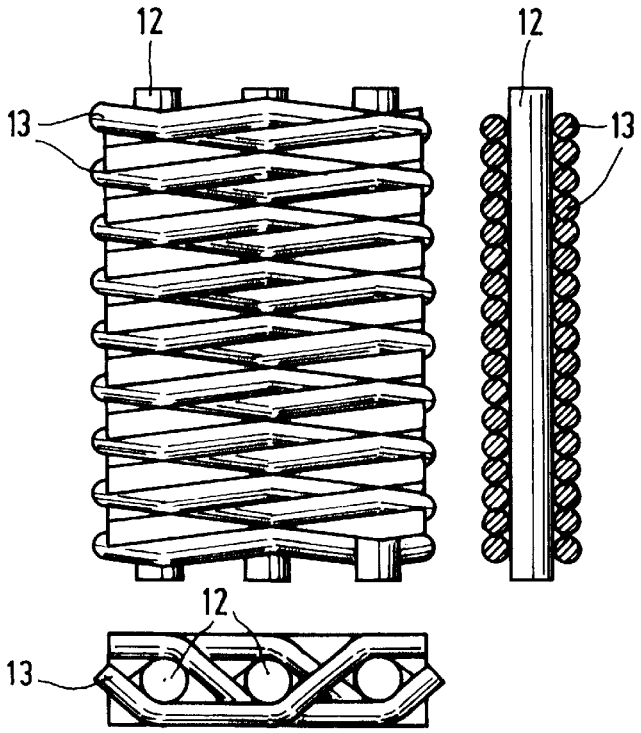
Figure 3A:
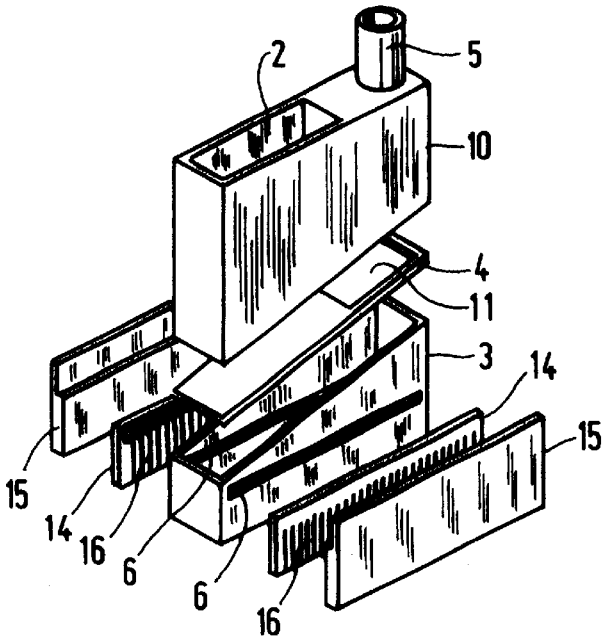
Figure 3B:
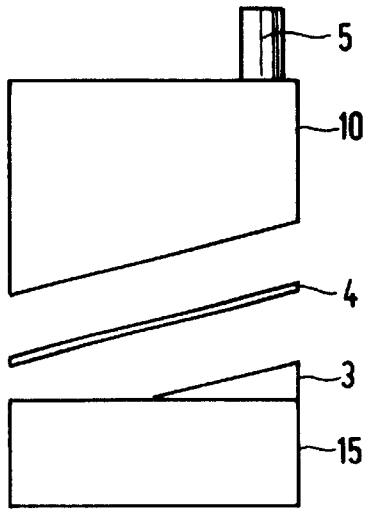
Figure 3C:
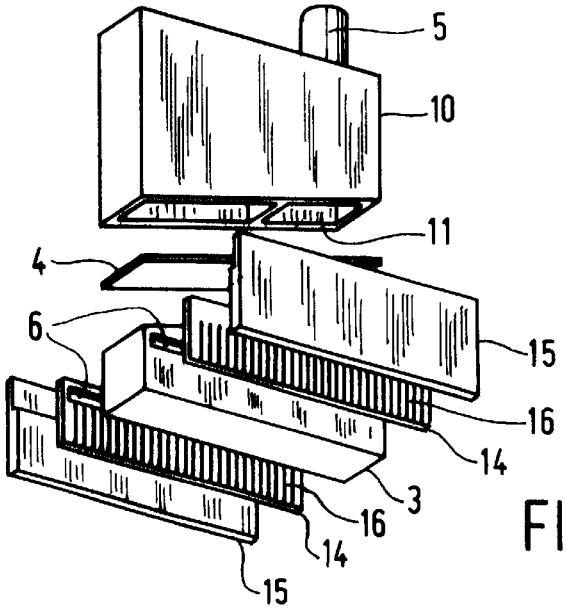
Figure 4:
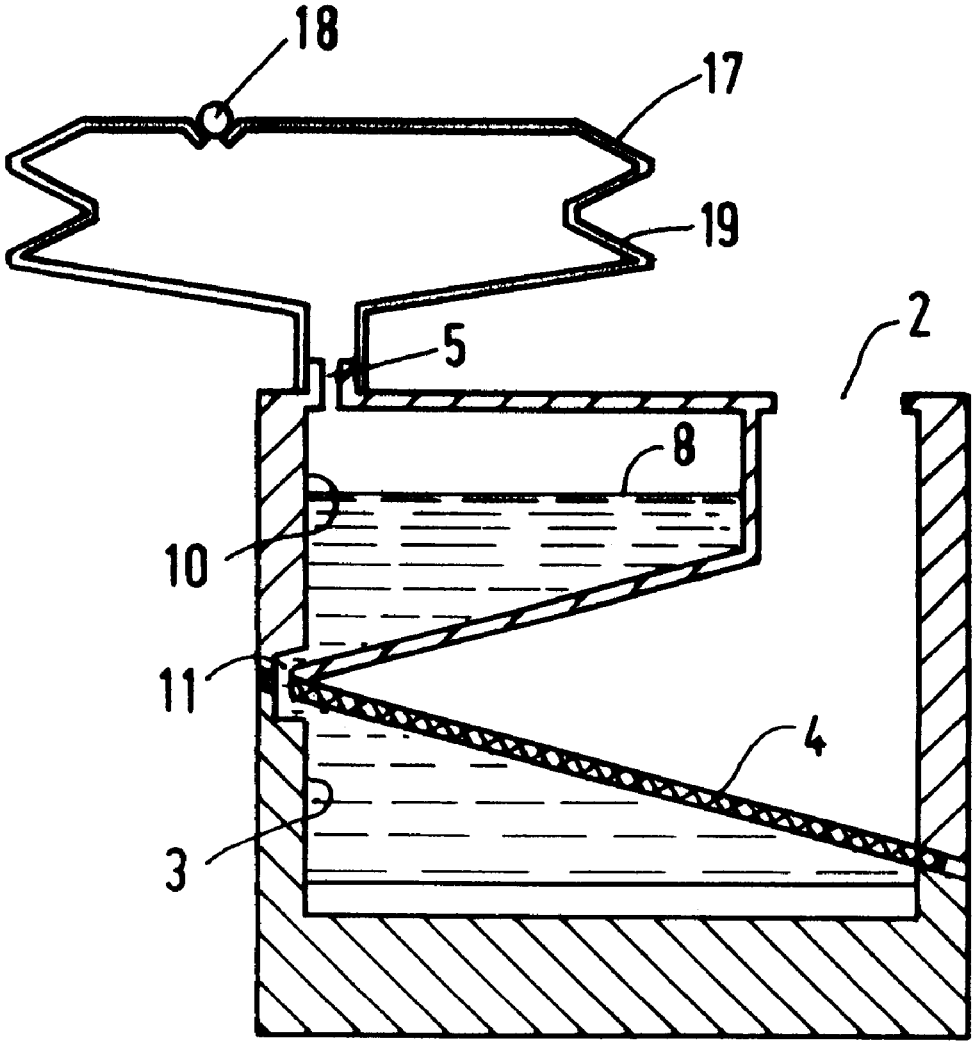
Figure 5A:
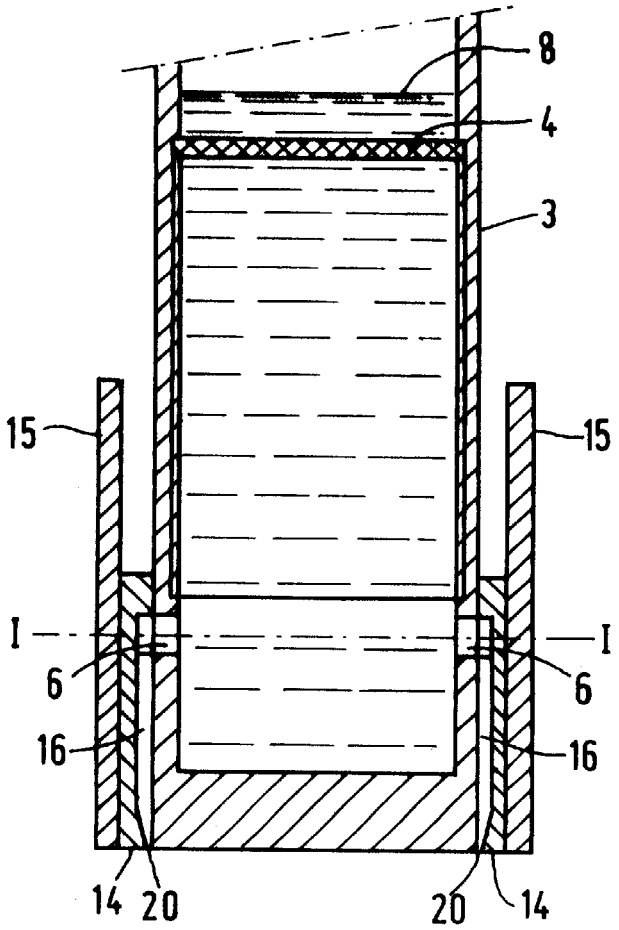
Figure 5B:
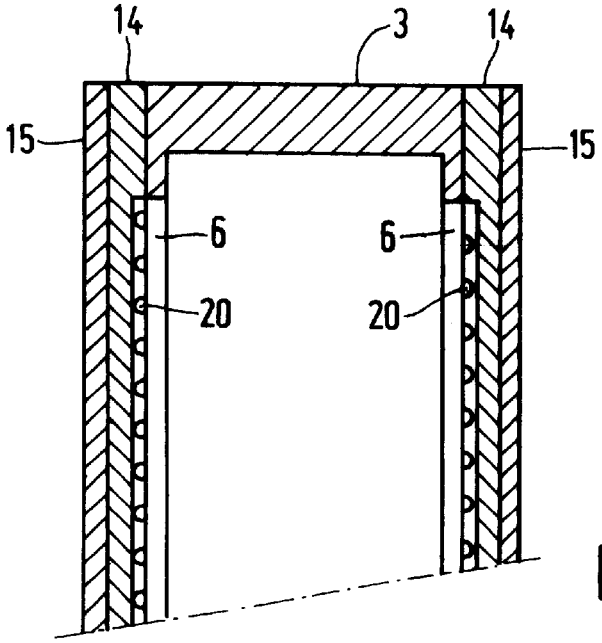

The apparatus according to the present invention will be explained in detail with reference to the follow figures wherein:

FIGS. 1A, 1B, 1C, 1D and 1E diagrammatically illustrate cross-sections of five different embodiments of an ink supply container according to the present invention;

FIGS. 2A and 2B show two embodiments of porous material;

FIGS. 3A, 3B and 3C include diagrammatic perspective views of the ink supply container of FIG. 1C in combination with an inkjet printhead;

FIG. 4 shows the ink supply container of FIG. 1C in combination with a means for applying a negative pressure; and FIGS. 5A and 5B diagrammatically show details of the ink supply container and inkjet printhead shown in FIG. 3.

DETAILED DESCRIPTION OF THE INVENTION

FIG. 1A shows a first embodiment of an ink supply container 1 according to the present invention. The ink supply container 1 comprises an ink supply opening 2 for supplying ink from a larger ink reservoir, not shown in detail. An ink chamber 3 is formed by the wall of the ink supply container 1 and a separate wall of porous material 4. This porous material 4 separates the ink chamber 3 from the ink supply opening 2. An opening 5 leading into the ink chamber 3 is also provided in the wall of the ink supply container 1. The opening 5 serves as a connecting means (not shown in detail) for applying a negative pressure to the ink chamber 3. Finally, an ink outflow opening 6 is diagrammatically shown, such opening being suitable for connection to an inkjet printhead (not shown). Further details concerning the means for applying a negative pressure and concerning the inkjet head will be explained by reference to the following figures.

FIG. 1A also shows where the ink 7 is situated in an operative mode. The ink level 8 is shown diagrammatically. It should also be noted that the ink supply container 1 according to the present invention is suitable both for water-based ink liquid at room temperature and for meltable ink which is not liquid at room temperature. This latter ink is also known as hotmelt ink. When meltable ink of this kind is used, the ink supply container 1 is heated by heating means suitable for this purpose, in order to keep the ink present therein in liquid state.

The ink chamber 3 the liquid ink supplied via the ink supply opening 2 is passed through the porous material 4 to the ink chamber 3. Since the microducts (not shown in detail) present in the porous material 4 will be filled with ink in this circumstance, the porous material 4 will on the other hand be in an ink-saturated state practically impermeable to air. As a result, a negative pressure can be maintained in the ink chamber 3 while a continuous supply of ink is possible.

It should be noted that minuscule air bubbles present in the ink through diffusion can diffuse through the ink. This is a slow process, however. Despite this diffusion, the resistance to air is still such that a negative pressure can be maintained over a long time. The pressure loss occurring as a result of the said diffusion can, if necessary, be constantly or periodically compensated for by using the opening 5 and any means suitable for achieving the desired purpose.

If there is no supply of ink via the ink supply opening 2, the capillary action of the microducts in the porous material 4 will cause ink to remain therein, so that the porous layer 4 will remain saturated with ink. The maximum size of the microducts with which the effect thus described is obtained will be determined, on the one hand, by the properties of the ink to be used and, on the other hand, by the shape and length and surface properties of the microducts. The surface tension of the ink plays a particularly important part in this system. In practice, a negative pressure is maintained in the ink chamber 3 corresponding to a pressure exerted by a water column of a height of from 10 to 200 mm. The pressure required is also determined by the size of the nozzles of a connected inkjet printhead.

If ink is again supplied via the ink supply opening 2, then the surface tension of the ink blocking the microducts in the porous material 4 will be broken and there will be a transport of ink to the ink chamber 3. In the arrangement shown in FIG. 1A, with the gravity direction 9 in the operative mode being perpendicular to the major transverse plane of the porous material 4, such transport of the ink will be effected by gravity alone. However, the negative pressure present in the ink chamber 3 will also effect the transport of ink towards the ink chamber 3. Therefore, the transverse plane of the porous material 4 need not necessarily be oriented perpendicularly with respect to the direction of gravity 9.

FIG. 1B is an example of a second embodiment in which the transverse plane of the porous material 4 is disposed at an angle of less than 90° to the gravity direction 9. Also, in the embodiment according to FIG. 1B the porous material 4 is in continuous liquid connection with the ink 7 in the ink chamber 3, in the operative mode. As a result, this provides extra security that the porous material 4 remains saturated with ink. The negative pressure present in the ink chamber 3 now plays a more important part in order to keep the ink 7 in the ink chamber 3.

FIG. 1C shows a third embodiment in which the entire transverse plane of the porous material 4 is now in liquid contact with the ink 7 present in an operative mode. For this purpose, the ink supply container is now provided with a second ink chamber 10 in addition to the above-mentioned first ink chamber 3. The second ink chamber 10 is higher than the first ink chamber 3 and is in liquid communication therewith via a duct 11. In an operative mode, the ink level 8 is higher, as viewed in the gravity direction 9, than the porous material 4.

A further advantage of the embodiment shown in FIG. 1C is that any air bubbles present in the ink 7 will not accumulate over the entire surface of the porous material 4, but will migrate to the highest point of the ink chamber 3. The air accumulating here will finally pass to the second ink chamber 10 through the duct 11. The advantage of this is that the first ink chamber 3 remains free of air as far as possible, thus reducing the risk of blockage of the ink outflow opening 6 by an air bubble. In this connection it should be noted that any air present in an inkjet head connected to the ink supply container 1 can be removed from the inkjet printhead by pressure pulses applied briefly in the ink chambers 10 and 3 by means suitable for this purpose (not shown in detail).

Figure 1D:
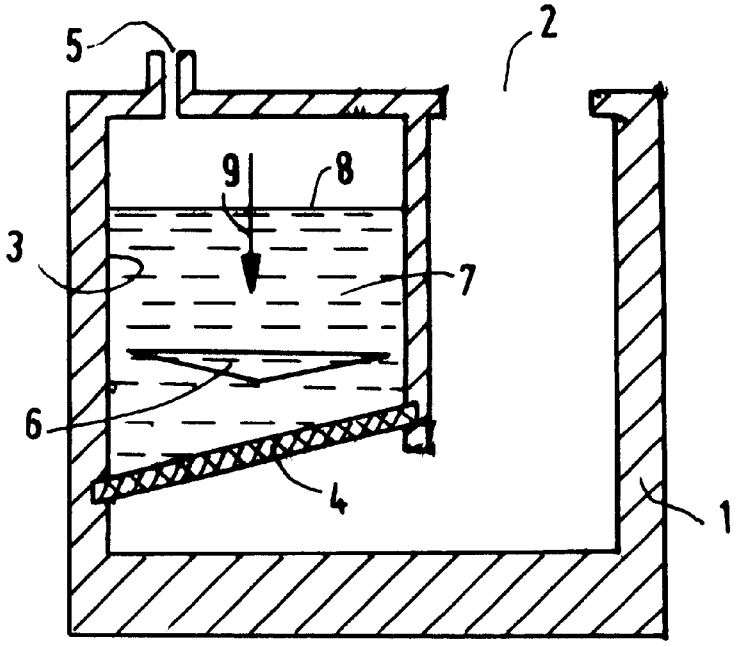

FIG. 1D shows an embodiment in which the porous material 4 is beneath the ink chamber 3 in the operative mode, with the direction of gravity corresponding to the direction 9 as indicated. Like the embodiment shown in FIG. 1C, this embodiment has the advantage that the porous material is always in contact with the ink in ink chamber 3 over the entire surface, but now without the second ink chamber 10 as required in FIG. 1C.

Figure 1E:
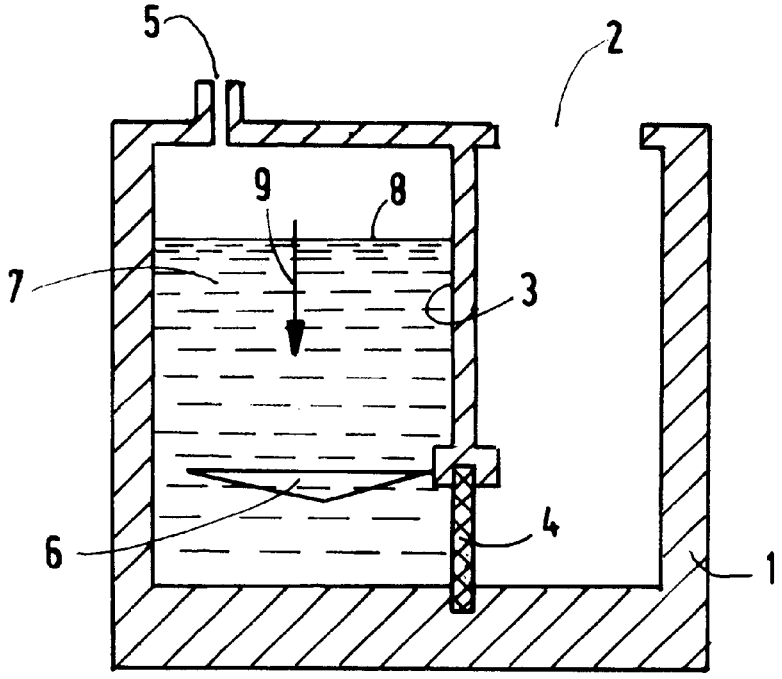

FIG. 1E finally shows a simple embodiment in which the surface of the porous material 4 in its operative mode is disposed parallel to the gravity direction 9.

The porous material 4 can, for example, consist of solid, stone-like material but can also be formed by a woven fabric of threads or wires such as, for example, regularly woven sieve gauze with a fixed mesh width. One advantageous embodiment of a woven fabric of this kind is shown in FIG. 2.

The woven fabric shown in FIGS. 2A and 2B is of the type in which the threads or wires 12 in a first weaving direction are thicker than the threads or wires 13 in a second weaving direction. The thinner threads or wires 13 will, in these conditions, be the most subjected to deformation. As a result, the openings formed by the threads or wires 12 and 13 are not situated in the same plane but are curved. These openings do not lie solely perpendicularly to the direction of the ink throughflow and thus form a greater resistance thereto. Moreover, this type of woven fabric gives a smoother surface. This type of gauze is known as "Dutch weave". An effective woven fabric is obtained by using stainless steel wire of a diameter of 25 micrometers for the thin threads or wires 13 and stainless steel wire with a diameter of 50 micrometers for the thick threads or wires 12. The throughflow opening to be formed under these conditions is determined by a retention size of between 5 and 30 micrometers and preferably between 10 and 15 micrometers. The retention size is determined by the maximum size of a glass bead which can still pass through the woven fabric. The retention size is determined experimentally by using a suspension of glass beads of various sizes. An indirect and more practical measurement is a "bubble point test", in which the positive pressure is measured for overcoming the surface tension in an immersed piece of woven fabric.

The size of the openings in the porous material 4 or, in the case of the "Dutch weave", the retention size, is related to the negative pressure required and hence the size of the nozzles of the connected inkjet printhead. The smaller the size of the openings in the porous material 4, the less the risk of the porous material 4 passing too much air. A small opening size, however, does not obstruct the throughflow of the ink to be supplied, so that a compromise must be drawn.

FIG. 2B shows an embodiment of filter gauze in which the thinner wires 13 are arranged after the style of pantiles (panatelas?).

FIG. 3A shows, three-dimensionally, the ink supply container 1 of the embodiment shown in FIG. 1C in combination with an inkjet printhead. Accordingly, the numbering used for the separate parts of the ink supply container corresponds to the numbering of FIG. 1C and will not be explained further. Each of the ink outflow openings 6 provided on the two sides of the first ink chamber 3 is connected to a duct plate 14 with liquid ducts 16 therein, such ducts being shown diagrammatically and leading into nozzles (not shown). The diameter of these nozzles is about 30 micrometers. Opposite the duct plate 14 is an actuator plate 15 comprising piezo-electric material. The piezo-electric material is so arranged that each liquid duct 16 of the duct plate 14 can be influenced separately by applying a voltage pulse to a part of the piezo-electric material which corresponds to said liquid duct 16 and which is to be controlled separately. The resulting deformation of the piezo-electric material results in a constriction in the corresponding liquid duct 16 so that the ink present therein is ejected via the nozzle.

The ink supply container according to the present invention is not restricted to an inkjet head of this type. Instead of an inkjet printhead of the piezo-electric type, it is also possible to utilize an inkjet printhead of the thermal type. In this case, the ink present in a liquid duct is briefly heated so that a vapour bubble is formed which ejects the ink present in the liquid duct.

FIG. 4 shows the ink supply container embodiment illustrated in FIG. 1C and FIG. 3, but now in combination with an advantageous embodiment of means for applying and maintaining a negative pressure in the ink chambers 3 and 10. A bellows 17 is connected to the opening 5 of the ink chamber 10. The bellows 17 consists of an elastic material with a number of folds 19. In an operative mode, the bellows 17 is in a partly collapsed state so that as a result of the force exerted by the elastic material, the required negative pressure is obtained. Volume variations due to changes in the ink level 8 are absorbed by volume variations of the bellows 17. As a result the negative pressure remains substantially constant. A non-return valve 18 is finally provided to allow air present in the bellows 17 to escape on filling.

It should be noted in this connection that other means can be considered for applying and maintaining a negative pressure. Examples are a diaphragm in combination with a spring mechanism or a piston and cylinder combination.

FIG. 5A shows in greater detail a cross-section of the ink supply container of FIG. 3 in combination with an inkjet printhead. How the ink outflow opening 6 of the ink chamber 3 of the ink supply container connects with the liquid ducts 16 of the duct plate 14 is now more readily visible. The nozzles 20 of the ducts 16 are now also more readily visible. FIG. 5B is a cross-section of the ink supply container and the inkjet printhead taken along line I—I shown in FIG. 5A.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. An ink supply container comprising at least one ink chamber, ink inlet means provided in said ink supply container for introducing ink into said ink chamber ink outlet means for removing said ink from said ink chamber, said ink outlet means being adapted to be connected to an inkjet printhead, a porous material disposed between the ink inlet and the ink chamber and, additional to the porous material, means operatively associated with said ink supply container for applying and maintaining a negative pressure in the ink chamber.

2. The ink supply container according to claim 1, wherein the porous material has large and small dimensions, its small dimension pointing in the direction towards the ink chamber.

3. The ink supply container according to claim 2, wherein the porous material is permeable to ink both in a direction pointing towards the ink chamber and in a direction perpendicular thereto.

4. The ink supply container according to claim 1, wherein the porous material is formed by a regular woven fabric of threads or wires.

5. The ink supply container according to claim 4, wherein the threads or wires in a first weaving direction have a diameter differing from the threads or wires in a second weaving direction.

6. The ink supply container according to claim 4, wherein the woven fabric has openings situated in a throughflow direction with a maximum dimension of between 5 and 30 micrometers.

7. The ink supply container according to claim 1, wherein at least part of the porous material, an operative mode, is in liquid contact with the ink normally present in the ink chamber in its operative mode.

8. The ink supply container according to claim 1, wherein the ink supply container contains a first ink chamber and a second ink chamber, said second ink chamber being in liquid communication with the first ink chamber, said second ink chamber, in an operative mode, being positioned above the first ink chamber, relative to the direction of gravity.

9. The ink supply container according to claim 1, wherein the plane formed by the porous material and directed towards the ink chamber, in an operative state, is obliquely disposed with respect to the direction of gravity.

10. The ink supply container according to claim 1, wherein the ink supply container is provided with an opening leading out of at least one of the ink chambers and means for applying a substantially constant negative pressure is connected to said opening.

11. An inkjet system comprising an inkjet printhead and an ink supply container as defined in claim 1, wherein the inkjet printhead is provided with a plurality of nozzles with corresponding ink supply ducts which communicate with the ink outlet means of the ink supply container.

12. The ink supply container of claim 1, wherein the porous material is a solid, stone-like material.

13. An ink supply container comprising at least one ink chamber, ink inlet means provided in said ink supply container for introducing ink into said ink chamber, ink outlet means for removing ink from said ink chamber, said ink outlet means being adapted to be connected to an inkjet printhead, a porous material disposed within the ink supply container between the ink inlet and the ink chamber, said porous material, in an ink saturated state, being permeable to ink but substantially impermeable to air, and, additional to the porous material, means operatively associated with said ink supply container for applying and maintaining a negative pressure in the ink chamber.

* * * * *